US012687301B2

(12) United States Patent
Beining et al.

(10) Patent No.: US 12,687,301 B2
(45) Date of Patent: Jul. 21, 2026

(54) PORTABLE HEATER

(71) Applicant: MILWAUKEE ELECTRIC TOOL CORPORATION, Brookfield, WI (US)

(72) Inventors: Nathan Beining, Milwaukee, WI (US); Srdjan Acimovic, Hales Corners, WI (US); Jon Pinske, Pewaukee, WI (US); Emily Siira, Waukesha, WI (US); Grace Widmeyer, Cincinnati, OH (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 345 days.

(21) Appl. No.: 18/551,232

(22) PCT Filed: Mar. 29, 2022

(86) PCT No.: PCT/US2022/022290
§ 371 (c)(1),
(2) Date: Sep. 19, 2023

(87) PCT Pub. No.: WO2022/212331
PCT Pub. Date: Oct. 6, 2022

(65) Prior Publication Data

US 2024/0175583 A1 May 30, 2024

Related U.S. Application Data

(60) Provisional application No. 63/167,928, filed on Mar. 30, 2021.

(51) Int. Cl.
*F24C 3/08* (2006.01)
*F24C 3/04* (2021.01)
(Continued)

(52) U.S. Cl.
CPC ..... *F24C 3/08* (2013.01); *F24C 3/04* (2013.01); *F24C 3/10* (2013.01); *F24C 3/12* (2013.01)

(58) Field of Classification Search
CPC ..... F24C 3/08; F24C 3/04; F24C 3/10; F24C 3/12; F23N 2241/02
(Continued)

(56) References Cited

U.S. PATENT DOCUMENTS 2,362,258 A * 11/1944 Findley ..... B60H 1/2212 126/93
4,718,846 A 1/1988 Oguri et al.
(Continued)

FOREIGN PATENT DOCUMENTS

CN 2521529 Y 11/2002
CN 2788054 Y 6/2006
(Continued)

OTHER PUBLICATIONS

Mr. Heater, "Buddy FLEX® Heater," <https://www.mrheater.com/buddy-flex-heater.html> web page visted Sep. 22, 2023 (7 pages).
(Continued)

*Primary Examiner* — Vivek K Shirsat
(74) *Attorney, Agent, or Firm* — Michael Best & Friedrich LLP

(57) ABSTRACT

A portable heater includes a housing defining a base portion and a radiant heating assembly positioned within the housing. The radiant heating assembly includes a connector configured to receive a fuel tank having a combustible fuel, an ignition assembly configured to ignite the combustible fuel, and a radiant heating surface configured to be heated by ignition of the combustible fuel. The radiant heating surface is configured to emit radiant energy to a surrounding environment. An air flow channel is formed in the housing defines an intake opening and an exhaust opening. The exhaust opening is positioned proximate the radiant heating surface. A fan is positioned within the air flow channel to induce an airflow through the air flow channel. The airflow
(Continued)

exits the exhaust opening to disperse the radiant energy from the radiant heating surface to the surrounding environment.

19 Claims, 9 Drawing Sheets

(51) Int. Cl.
*F24C 3/10* (2006.01)
*F24C 3/12* (2006.01)

(58) Field of Classification Search
USPC ..... 431/258, 329; 126/92 AC
See application file for complete search history.

(56) References Cited

U.S. PATENT DOCUMENTS 5,165,883 A 11/1992 Van Bemmel
5,807,098 A 9/1998 Deng
5,984,663 A 11/1999 Joyce
6,026,800 A 2/2000 Barker
6,065,468 A 5/2000 Willey et al.
6,102,031 A 8/2000 Waters
6,152,128 A 11/2000 Willey et al.
6,164,273 A 12/2000 Waters
6,192,878 B1 2/2001 Waters
6,213,761 B1 4/2001 Schmidt
6,340,298 B1 1/2002 Vandrak et al.
6,446,623 B1 9/2002 Resmo et al.
6,470,876 B1 10/2002 Schmidt et al.
6,470,877 B1 10/2002 Waters
6,619,281 B2 9/2003 Resmo et al.
6,648,635 B2 11/2003 Vandrak et al.
6,651,647 B2 11/2003 Waters
6,681,760 B2 1/2004 Topp
6,742,814 B2 6/2004 Resmo et al.
6,792,937 B2 9/2004 Resmo et al.
6,843,244 B2 1/2005 McCalley et al.
6,857,870 B2 2/2005 Topp
6,880,549 B2 4/2005 Topp
6,884,065 B2 4/2005 Vandrak et al.
6,941,677 B2 9/2005 Adrian
7,300,278 B2 11/2007 Vandrak et al.
7,434,447 B2 10/2008 Deng
7,600,998 B1 10/2009 Pitchford et al.
7,607,426 B2 10/2009 Deng
7,654,820 B2 2/2010 Deng
7,677,236 B2 3/2010 Deng
7,730,765 B2 6/2010 Deng
7,766,006 B1 8/2010 Manning
7,886,734 B2 2/2011 Jin
7,967,006 B2 6/2011 Deng
7,967,007 B2 6/2011 Deng
7,997,004 B1 8/2011 Adrian
8,025,048 B1 9/2011 Scarborough
8,053,709 B2 11/2011 Vandrak et al.
8,057,219 B1 11/2011 Manning et al.
8,061,347 B2 11/2011 Manning
8,068,724 B2 11/2011 Vandrak et al.
8,118,590 B1 2/2012 Manning et al.
8,235,708 B2 8/2012 Deng
8,281,781 B2 10/2012 Deng
8,317,511 B2 11/2012 Deng
8,347,875 B2 1/2013 Jamieson
8,403,661 B2 3/2013 Mateos Martin
8,434,469 B2 5/2013 Vandrak
8,465,277 B2 6/2013 Deng
8,469,020 B1 6/2013 Northrup
8,485,175 B1 7/2013 Hayes et al.
8,487,221 B2 7/2013 Vandrak et al.
8,494,350 B2 7/2013 O'Toole et al.
8,516,878 B2 8/2013 Deng
8,517,718 B2 8/2013 Deng
8,540,509 B1 9/2013 Cantal
8,568,136 B2 10/2013 Deng
8,684,276 B2 4/2014 Vandrak
8,752,541 B2 6/2014 Deng
8,757,139 B2 6/2014 Deng
8,757,202 B2 6/2014 Deng
8,777,609 B2 7/2014 Mateos Martin
8,819,957 B1 9/2014 Adrian
8,851,065 B2 10/2014 Deng
8,863,736 B2 10/2014 Vandrak
8,886,024 B2 11/2014 Tyburk
8,893,706 B2 11/2014 Vandrak et al.
8,893,707 B2 11/2014 Jamieson
8,915,239 B2 12/2014 Deng
8,985,094 B2 3/2015 Deng
9,021,859 B2 5/2015 Deng
9,097,422 B2 8/2015 Deng
9,140,457 B2 9/2015 Deng
9,170,016 B2 10/2015 Deng
9,222,670 B2 12/2015 Deng
9,222,682 B2 12/2015 Vandrak
9,267,704 B1 2/2016 Lee, Jr.
9,267,708 B2 2/2016 Jamieson
9,273,872 B1 3/2016 Lee, Jr.
9,328,927 B2 5/2016 Wang
9,404,671 B2 8/2016 Liang
9,416,977 B2 8/2016 Deng
RE46,308 E 2/2017 Mateos Martin
9,587,830 B2 3/2017 Deng
9,739,389 B2 8/2017 Deng
9,752,782 B2 9/2017 Deng
9,829,195 B2 11/2017 Deng
9,835,358 B2 12/2017 Jin et al.
9,890,951 B2 2/2018 Wang
9,897,312 B2 2/2018 Wang
9,927,144 B2 3/2018 Vandrak et al.
9,995,505 B2 6/2018 Giaretta et al.
10,036,571 B1 7/2018 Gove et al.
10,066,838 B2 9/2018 Deng
10,066,854 B2 9/2018 Giaretta et al.
10,073,071 B2 9/2018 Deng
10,101,057 B2 10/2018 Giaretta et al.
10,107,493 B2 10/2018 Wang
10,222,057 B2 3/2019 Deng
10,240,789 B2 3/2019 Deng
10,429,074 B2 10/2019 Deng
10,495,344 B2 12/2019 Vandrak et al.
10,746,437 B2 8/2020 Giaretta et al.
10,837,668 B2 11/2020 Ye
12,018,846 B2 * 6/2024 Erisgen ..... F24C 3/122
2003/0012563 A1 1/2003 Neugebauer et al.
2003/0221686 A1 12/2003 Ahmady
2007/0277803 A1 12/2007 Deng
2008/0153045 A1 6/2008 Deng
2008/0272108 A1 11/2008 Maitland et al.
2008/0285258 A1 11/2008 Maitland et al.
2008/0302351 A1 12/2008 Hunter et al.
2011/0045417 A1 2/2011 Vandrak
2011/0290229 A1 12/2011 Manning
2011/0303211 A1 12/2011 Gove et al.
2012/0012103 A1 1/2012 Deng
2012/0094244 A1 4/2012 Vandrak
2012/0145693 A1 6/2012 Deng
2012/0180784 A1 7/2012 Vandrak
2012/0240916 A1 9/2012 Jedrzejek
2013/0008423 A1 1/2013 Noble et al.
2014/0305427 A1 10/2014 Liang
2015/0030318 A1 1/2015 Tyburk
2015/0125135 A1 5/2015 Tyburk et al.
2016/0131394 A1 5/2016 Liang
2016/0161146 A1 6/2016 Deng
2016/0258618 A1 9/2016 Galletti et al.
2017/0138604 A1 5/2017 Deng
2017/0363326 A1 12/2017 Vandrak et al.
2017/0363327 A1 12/2017 Vandrak et al.
2018/0266679 A1 9/2018 Pablo Curto et al.
2019/0041093 A1 2/2019 Vandrak et al.
2019/0137097 A1 5/2019 Deng
2019/0145663 A1 5/2019 Huggins et al.
2019/0170349 A1 6/2019 Martin
2020/0008416 A1 1/2020 Kieffer et al.

(56) References Cited

U.S. PATENT DOCUMENTS

| | | | | |
|---|---|---|---|---|
| 2020/0072500 | A1 | 3/2020 | Vandrak et al. | |
| 2020/0400345 | A1 | 12/2020 | Haak et al. | |
| 2021/0080112 | A1 | 3/2021 | Vandrak et al. | |
| 2022/0136704 | A1* | 5/2022 | Goodman | F24H 9/1881 432/32 |

FOREIGN PATENT DOCUMENTS

| | | | |
|---|---|---|---|
| CN | 201196454 | Y | 2/2009 |
| CN | 202209724 | U | 5/2012 |
| CN | 202328491 | U | 7/2012 |
| CN | 203571849 | U | 4/2014 |
| CN | 203880824 | U | 10/2014 |
| CN | 104676706 | A | 6/2015 |
| CN | 205137644 | U | 4/2016 |
| CN | 205939382 | U | 2/2017 |
| CN | 206073238 | U | 4/2017 |
| CN | 207831654 | U | 9/2018 |
| CN | 110425522 | A | 11/2019 |
| CN | 210663057 | U | 6/2020 |
| EP | 2434228 | A2 | 3/2012 |
| EP | 2863142 | A1 | 4/2015 |
| EP | 2784409 | B1 | 1/2017 |
| JP | 3556539 | B2 | 8/2004 |
| WO | 0052387 | A1 | 9/2000 |
| WO | 2003038347 | A1 | 5/2003 |
| WO | 2007000076 | A1 | 1/2007 |
| WO | 2014161551 | A1 | 10/2014 |
| WO | 2015090578 | A4 | 6/2015 |
| WO | 2019233538 | A1 | 12/2019 |

OTHER PUBLICATIONS

International Search Report and Written Opinion for Application No. PCT/US2022/022290 dated Jul. 15, 2022 (12 pages).

* cited by examiner

PORTABLE HEATER

CROSS-REFERENCE TO RELATED APPLICATIONS

This application is a national stage filing under 35 U.S.C. § 371 of International Application No. PCT/US2022/022290, filed on Mar. 29, 2022, which claims priority to U.S. Provisional Patent Application No. 63/167,928 filed on Mar. 30, 2021, the entire contents of which are incorporated herein by reference.

FIELD OF THE INVENTION

The present invention relates to a portable heater, and more particularly to a portable heater having a radiant heating assembly.

BACKGROUND OF THE INVENTION

There are various portable heaters known in the art for providing heat to a surrounding area. These portable heaters utilize various means known in the art to produce heat (e.g., via a radiant heating assembly, a combustion heating assembly, etc.) to heat the surrounding environment.

SUMMARY OF THE INVENTION

The present invention provides, in one aspect, a portable heater including a housing defining a base portion and a radiant heating assembly positioned within the housing. The radiant heating assembly including a connector configured to receive a fuel tank having a combustible fuel, an ignition assembly configured to ignite the combustible fuel, and a radiant heating surface configured to be heated by ignition of the combustible fuel. The radiant heating surface configured to emit radiant energy to a surrounding environment. An air flow channel formed in the housing. The air flow channel defining an intake opening and an exhaust opening, the exhaust opening positioned proximate the radiant heating surface. A fan positioned within the air flow channel to induce an airflow through the air flow channel. The airflow exits the exhaust opening to disperse the radiant energy from the radiant heating surface to the surrounding environment.

The present invention provides, in another aspect, a portable heater including a housing defining a base portion, a heating assembly positioned within the housing, the heating assembly including a radiant heating surface configured to emit radiant energy to a surrounding environment, an air flow channel formed in the housing, the air flow channel defining an intake opening and an exhaust opening, the exhaust opening positioned proximate the radiant heating surface, and a fan positioned within the air flow channel to induce an airflow through the air flow channel. The airflow exits the exhaust opening to disperse the radiant energy from the radiant heating surface to the surrounding environment.

The present invention provides, in another aspect, a portable heater including a housing, and a radiant heating assembly positioned within the housing. The radiant heating assembly including a connector configured to receive a fuel tank having a combustible fuel, an ignition assembly configured to ignite the combustible fuel, and a radiant heating surface configured to be heated by ignition of the combustible fuel, the radiant heating surface configured to emit radiant energy to a surrounding environment. An air flow channel formed in the housing, the air flow channel defining an intake opening and an exhaust opening. A fan disposed within the air flow channel and operable to induce an airflow through the air flow channel. The connector and the fuel tank are positioned between the fan and the intake opening, and the airflow induced by fan enters the air flow channel from an external environment, moves over the fuel tank to reduce heat surrounding the fuel tank, and exits the air flow channel to disperse the radiant energy from the radiant heating surface to the external environment.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
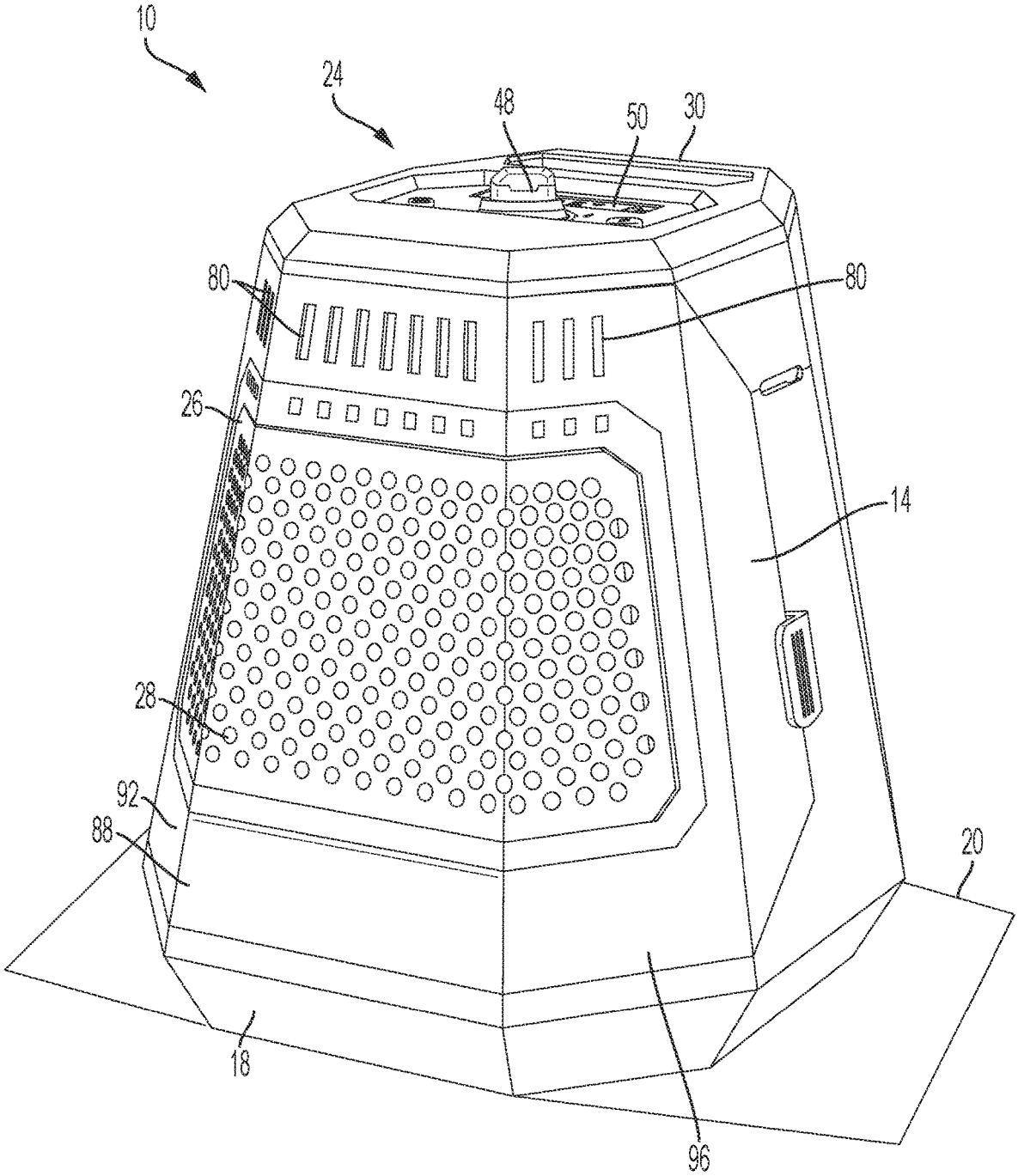
FIG. 1 is a perspective view of a portable heater in accordance with an embodiment of the invention.

FIG. 1 illustrates a portable radiant heater 10 for introducing infrared radiant heat to a surrounding environment. The portable radiant heater 10 includes a housing 14 defining a base portion 18 that supports the heater 10 relative to a surface 20, a heating assembly 22 (FIGS. 5 and 6) enclosed within the housing 14, and a user interface 24 located on a top portion of the housing 14 to selectively activate the heating assembly 22. In the illustrated embodiment, the housing 14 has an octagonal geometry where the base portion 18 has a larger width than the top portion of the heater 10. In other words, the housing 14 tapers inward as the housing 14 extends upwards from the base portion 18. In other embodiments, the housing may have an alternative geometry (e.g., circular, rectangular, etc.).

Figure 2:
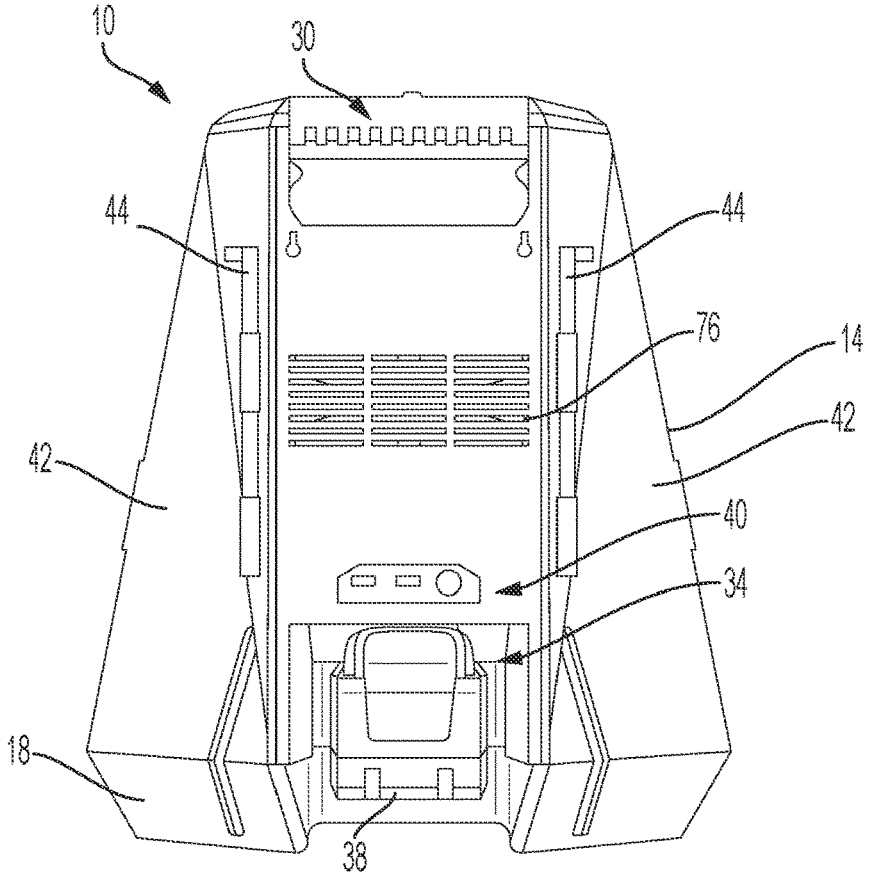
FIG. 2 is a rear view of the portable heater of FIG. 1.

The heater 10 may include a grate 26 that protects the heating assembly 22 within the housing 14. A plurality of apertures 28 may be formed in the grate 26 to allow the infrared radiant energy from the heating assembly 22 to escape from the housing 14 through the apertures 28. A handle 30 is formed on a rear portion of the top portion of the housing 14 (FIG. 2). In the illustrated embodiment, the handle 30 is formed as a recess in the housing 14, which the user may grasp to transport the heater 10. In other embodiments, the handle may have an alternative construction (e.g., be pivotably coupled to the housing 14, etc.).

Now with reference to FIG. 2, a battery receptacle 34 selectively receives a battery pack 38 that powers the user interface 24 and an ignition assembly 60 (FIGS. 5 and 6) of the heater 10, as described in more detail below. The battery pack 38 may be interchangeably coupled with the heater 10 or another power tool (e.g., a drill, a saw, etc.). The battery pack 38 may be a 12-volt power tool battery pack 38 that include three lithium-ion battery cells. Alternatively, the battery pack 38 may include fewer or more battery cells to yield any of a number of different output voltages (e.g., 14.4 volts, 18 volts, etc.). Additionally, or alternatively, the battery cells may include chemistries other than lithium-ion such as, for example, nickel cadmium, nickel metal-hydride, or the like. In some embodiments, the heater 10 may further include one or more back-up battery packs (e.g., 12 V battery packs, AAA battery packs, etc.). The heater 10 further includes a USB door 40 that selectively encloses a USB port. The USB port may receive a USB cord that can be used for charging an external device (e.g., a mobile device) using the battery pack 38.

Figure 3:
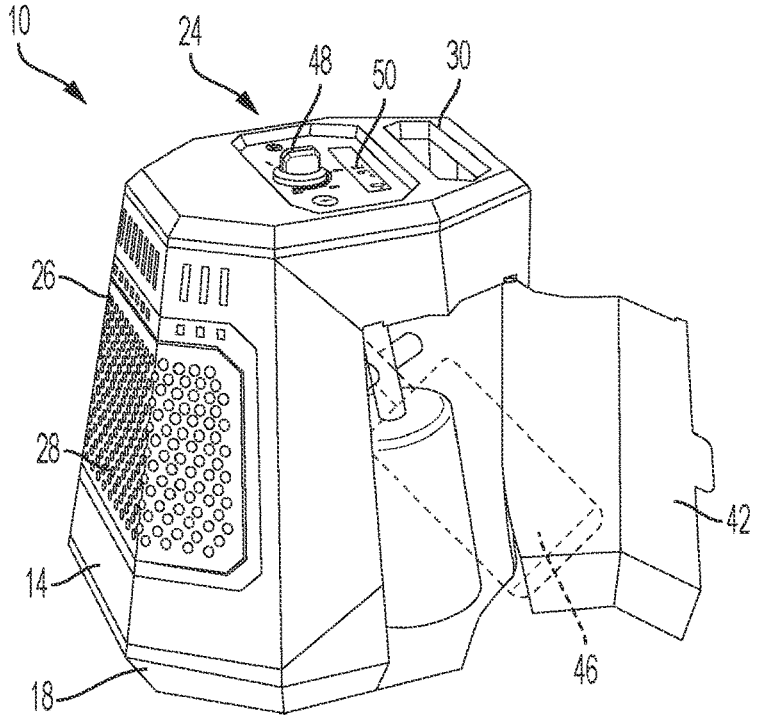
FIG. 3 is a side, perspective view of the portable heater of FIG. 1, illustrating a door in an open position for installation of a fuel tank.

Now with reference to FIGS. 2 and 3, each side of the housing 14 includes a door 42 that allows the operator to access an interior space of the heater 10. In the illustrated embodiment, each door 42 pivots about a pivot joint 44 (FIG. 2). The door 42 provides access to the interior space of the heater 10 so a user is able to install a fuel tank 46 (e.g., an 8 oz propane tank) having a combustible fuel in the heater 10. In other embodiments, the door 42 may have an alternative construction (e.g., sliding connection, etc.).

Figure 4:
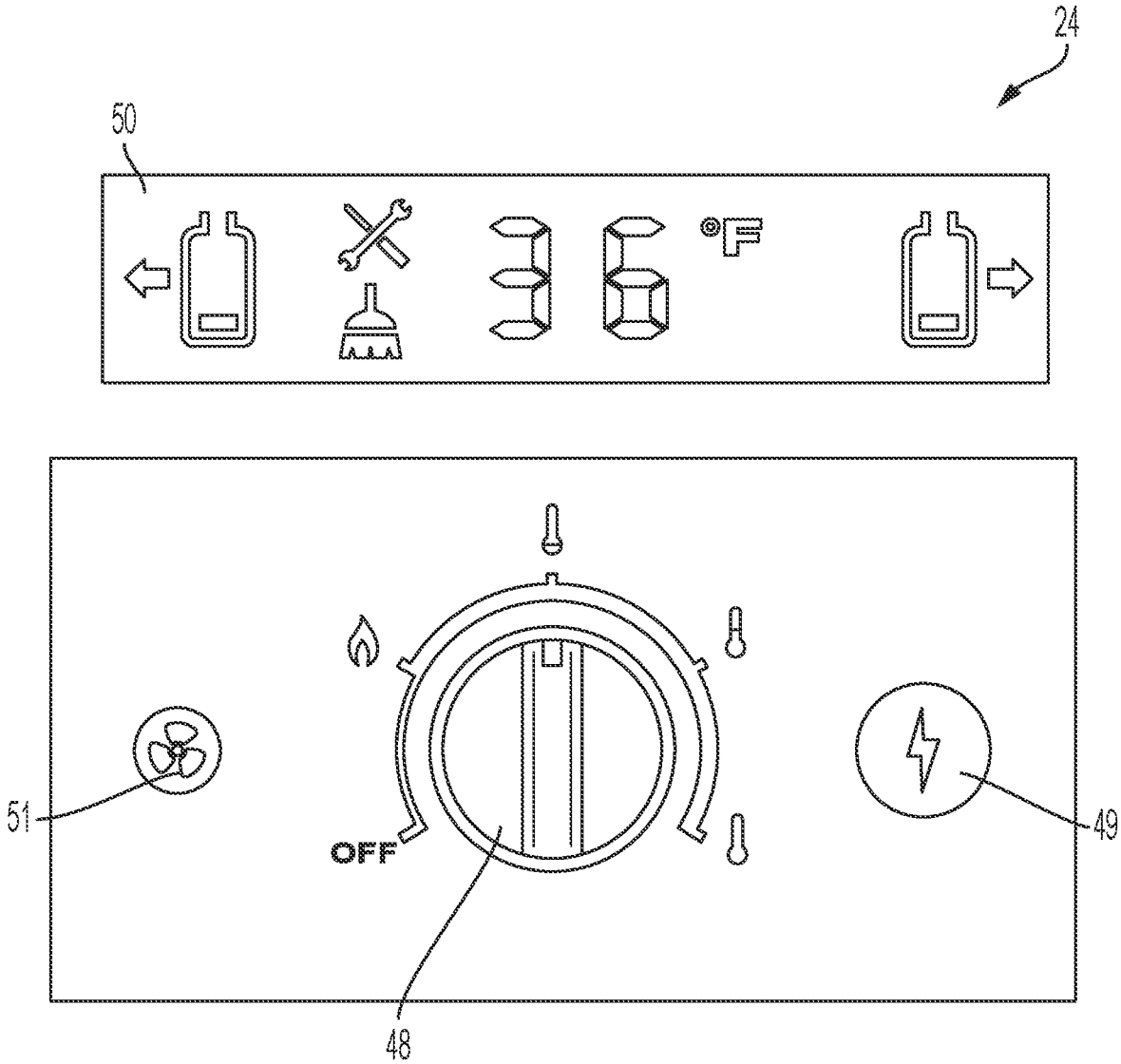
FIG. 4 is top view of a user interface of the portable heater of FIG. 1.
Figure 6:
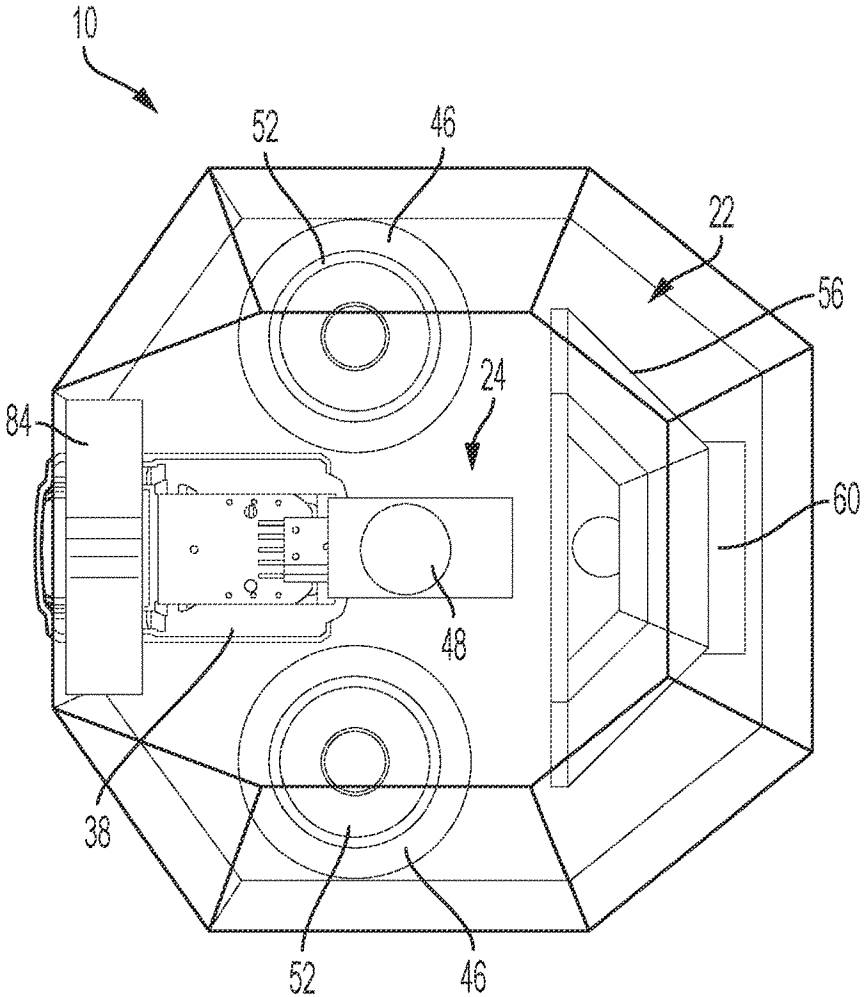
FIG. 6 is a top view of the portable heater of FIG. 1 with the housing of the heater being transparent to illustrate the internal components of the heater.
Figure 5:
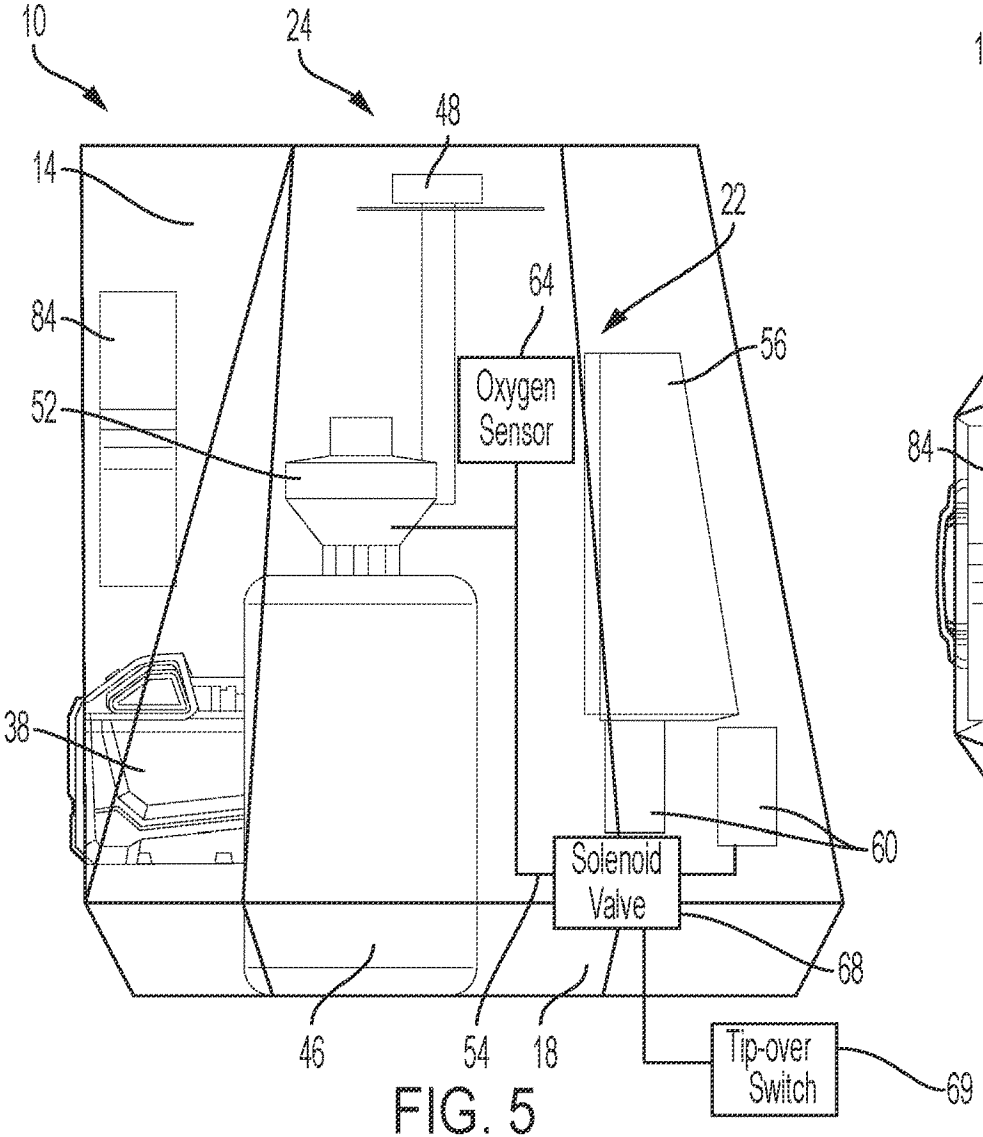
FIG. 5 is a side view of the portable heater of FIG. 1 with a housing of the heater being transparent to illustrate the internal components of the heater.

Now with reference to FIG. 4, the user interface 24 includes a rotatable dial 48 for controlling the heating assembly 22 and an LCD display 50. The dial 48 may control the amount of combustible fuel that is provided to the heating assembly 22 and may be moved between an OFF state, an ignition state, and an ON state. The LCD display 50 may display information to the user such as the state of the heater 10 (e.g., on, off, or ignition state), an error message (e.g., fuel empty, cleaning required, etc.), an external temperature of the surrounding environment, or the like. In some embodiments, the user interface 24 may include an ignition button 49 that selectively activates the ignition assembly 60 and a fan button 51 that selectively activates a fan 84 (FIGS. 5 and 6), which is described in more detail below:

Now with reference to FIGS. 5 and 6, the heating assembly 22 includes two connectors 52 that respectively connect to the fuel tanks 46, a fuel line 54 coupled to each connector 52, a radiant heating surface 56, and an ignition assembly 60. In the illustrated embodiment, the connectors 52 include a regulator that limits the volumetric flow rate of fuel from the fuel tank 46. The ignition assembly 60 is controlled by the user interface 24 and may be selectively activated to ignite the combustible fuel to heat the radiant heating surface 56. The ignition assembly 60 may include an igniter and a pilot light. In the illustrated embodiment, the dial 48 may be moved to the ignition state, which causes an extrusion on the dial 48 to compress an ignition switch. In response to the ignition switch being compressed, the igniter continuously provides a spark to ignite the combustible fuel. Once the fuel is ignited, the dial 48 may be moved to the ON state so the combustible fuel heats the radiant heating surface 56. The radiant heating surface 56 may be formed of materials such as chromel, ceramic, a Fecralloy metal fabric, or the like. In the illustrated embodiment, the radiant heating surface 56 is formed of Fecralloy metal fabric.

In some embodiments, the heater 10 may include an oxygen sensor 64 and a solenoid valve 68 in communication with the fuel line 54. The oxygen sensor 64 may be configured as a thermocouple that is exposed to the pilot light of the ignition assembly 60 and that is operable to detect that the flame emitted by the ignition assembly 60 has been extinguished. The solenoid valve 68 is responsive to input from the oxygen sensor 64 to selectively restrict fuel to the ignition assembly 60 in response to the oxygen sensor 64 detecting that the flame emitted by the ignition assembly 60 is extinguished. In some embodiments, the heater 10 may further include a tip-over switch 69 in communication with the solenoid valve 68, which sends a signal to the solenoid valve 68 and restricts fuel to the ignition assembly 60 when the heater 10 is tipped over.

Figure 7:
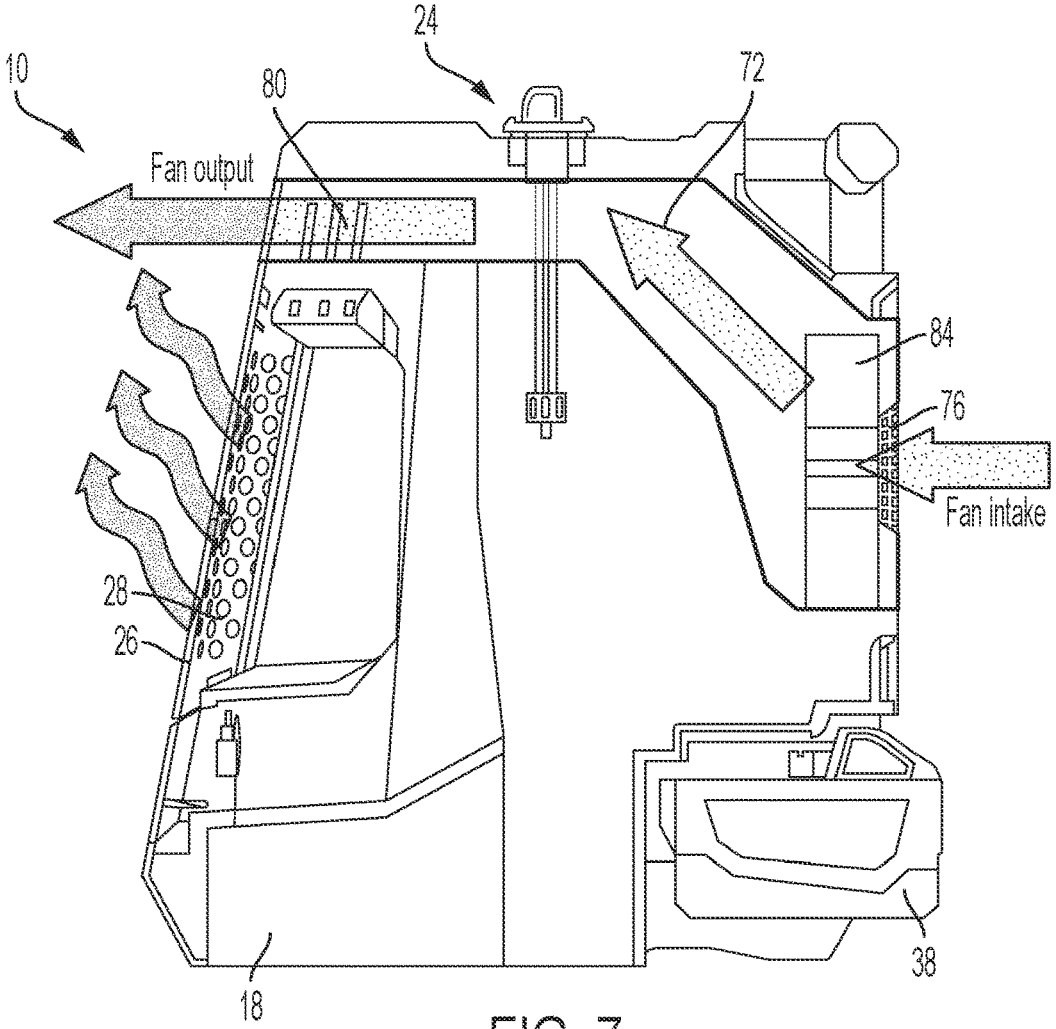
FIG. 7 is a side view of the portable heater of FIG. 1, illustrating an air flow path formed in the heater to disperse heated air to the surrounding environment.
Figure 8:
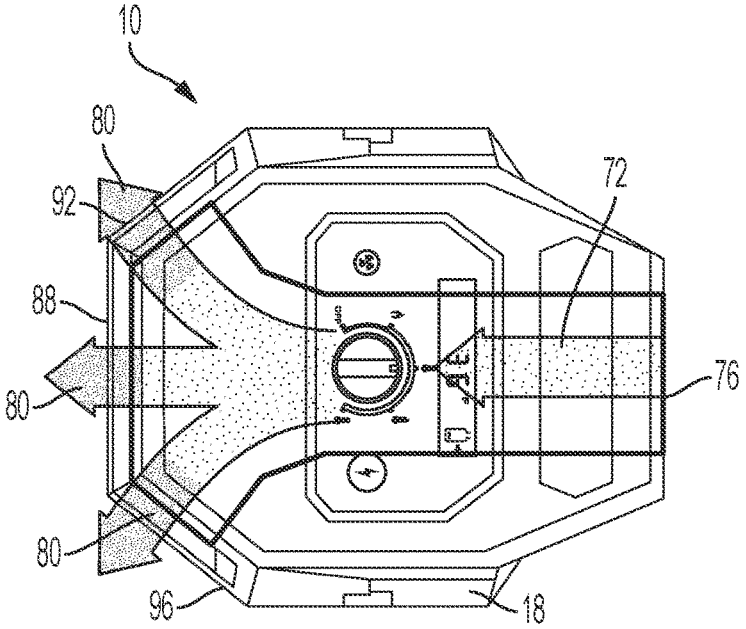
FIG. 8 is a top view of the portable heater of FIG. 1, illustrating the air flow path formed in the heater to disperse heated air to the surrounding environment.
Figure 9:
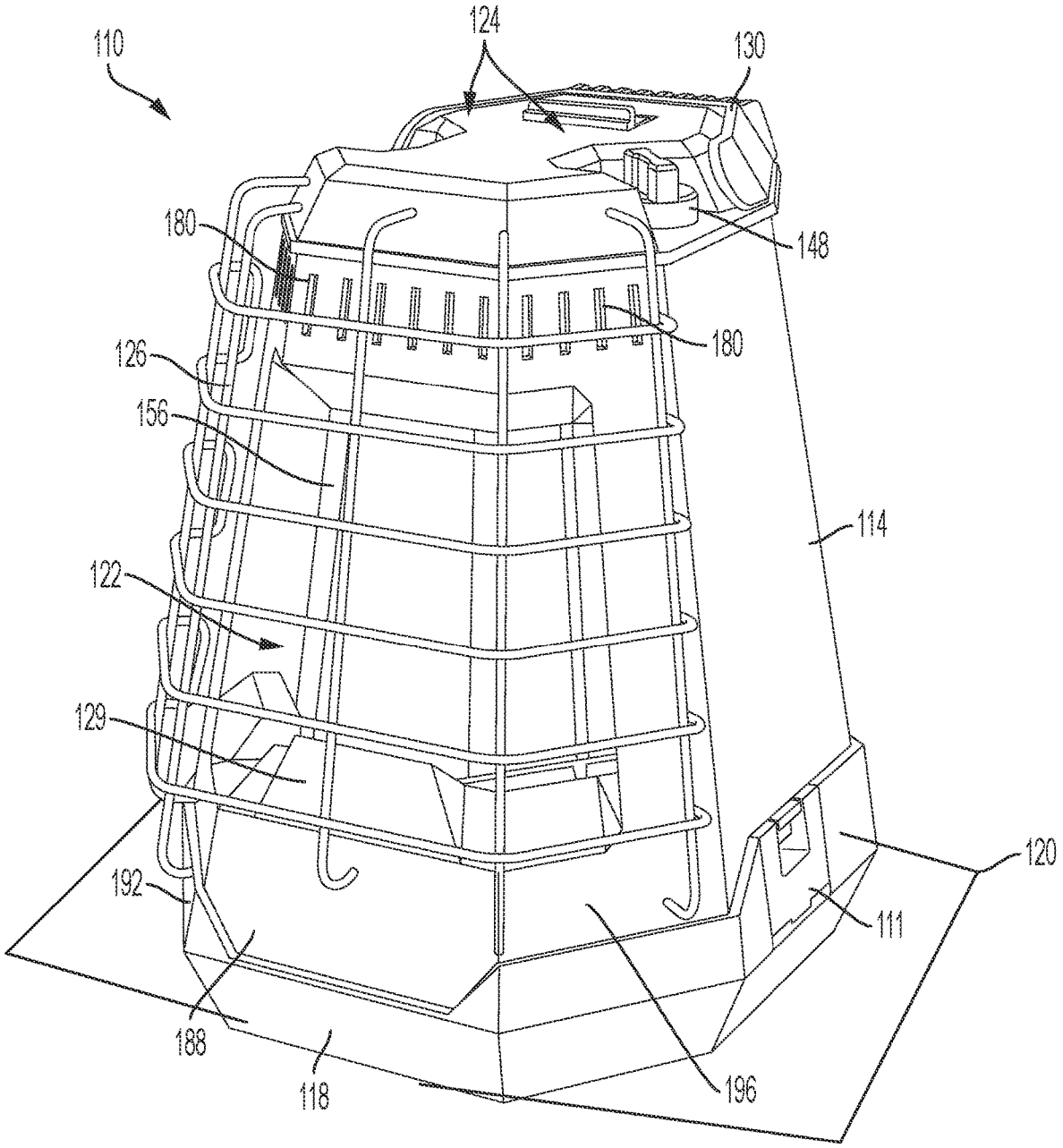
FIG. 9 is a perspective view of a portable heater in accordance with another embodiment of the invention.

Now with reference to FIGS. 7 and 8, an air flow channel 72 is formed in the housing 14 and extends between a rear portion and a front portion of the housing 14. The air flow channel 72 defines an intake opening 76 in the rear portion of the housing 14 and an exhaust opening 80 in the front portion of the housing 14 proximate the radiant heating surface 56. The intake and/or exhaust openings 76, 80 may be formed as a series of slits in the housing 14 as shown in FIGS. 1 and 2. In the illustrated embodiment, the exhaust opening 80 of the air flow channel 72 is positioned above the radiant heating surface 56 of the heating assembly 22 (FIG. 6). A fan 84 is positioned within the air flow channel 72 proximate the intake opening 76. Activation of the fan 84 (e.g., via the fan button 51 shown in FIG. 4) induces an airflow through the air flow channel 72 and out of the exhaust opening 80 to disperse the infrared radiant energy from the radiant heating surface 56 to the surrounding environment.

Now with reference to FIGS. 1 and 8, the exhaust opening 80 includes a plurality of openings 80 that are angled relative to each other to disperse the air moving through the air flow channel 72 in multiple directions at the front of the housing 14. In the illustrated embodiment, the exhaust opening 80 includes a first plurality of openings 80 formed on a front face 88 of the heater 10, a second plurality of openings 80 formed on a first angled surface 92, and a third plurality of openings 80 formed on a second angled surface 96. Therefore, the configuration of the exhaust opening 80 promotes dispersion of the air flow and the emitted radiant heat at the front of the housing 14.

FIGS. 9-14 illustrate a portable radiant heater 110 according to another embodiment of the invention. The portable radiant heater 110 is like the portable heater shown in FIGS. 1-8 and described above. Therefore, like features for the portable radiant heater 110 are identified with like reference numerals plus "100", and only the differences between the two will be discussed.

The portable radiant heater 110 includes a housing 114 defining a base portion 118 that supports the heater 110 relative to a surface 120, a heating assembly 122 supported within the housing 114, and a user interface 124 located on a top portion of the housing 14 to selectively activate the heating assembly 122. The heater 110 may include a wire grate 126 that protects the heating assembly 122 within the housing 114. A handle 130 is pivotably coupled a rear portion of the top portion of the housing 114 (FIG. 11).

Figure 11:
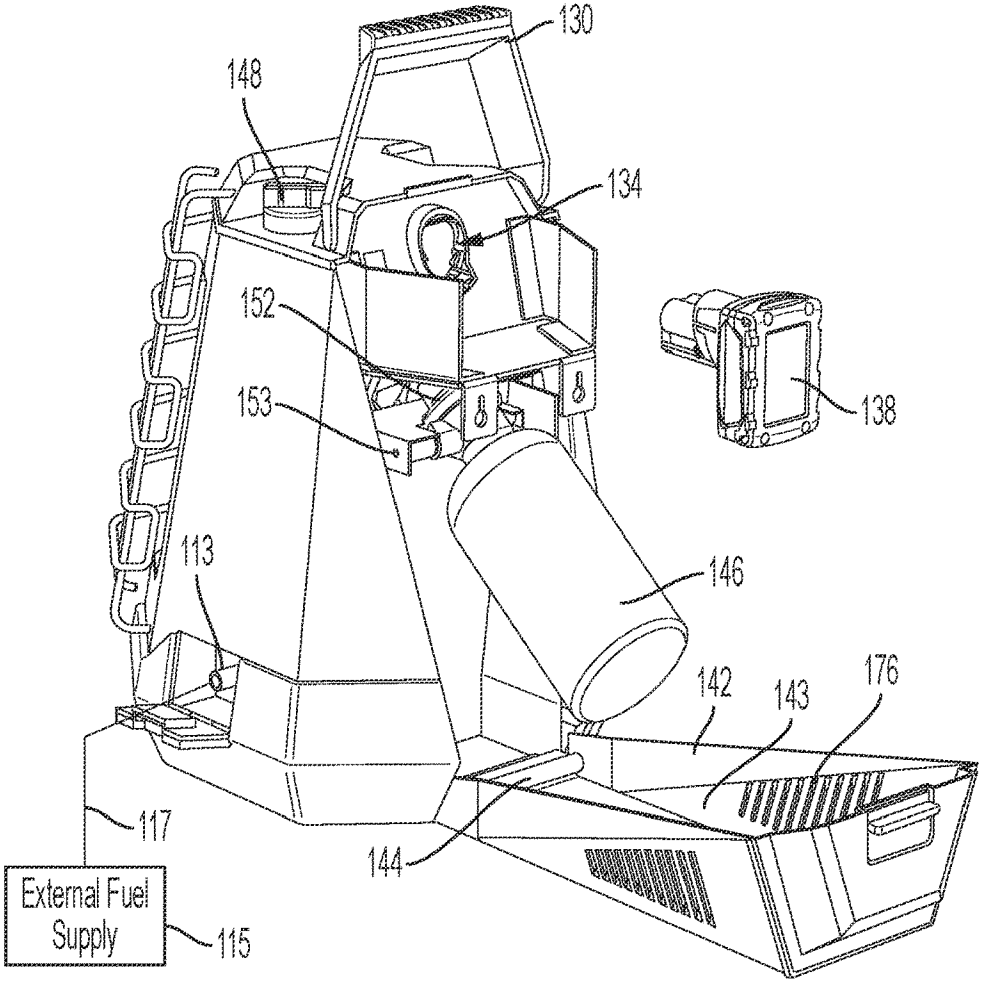
FIG. 11 is a rear perspective view of the portable heater of FIG. 9, illustrating a door in an open position for installation of a fuel tank.
Figure 10:
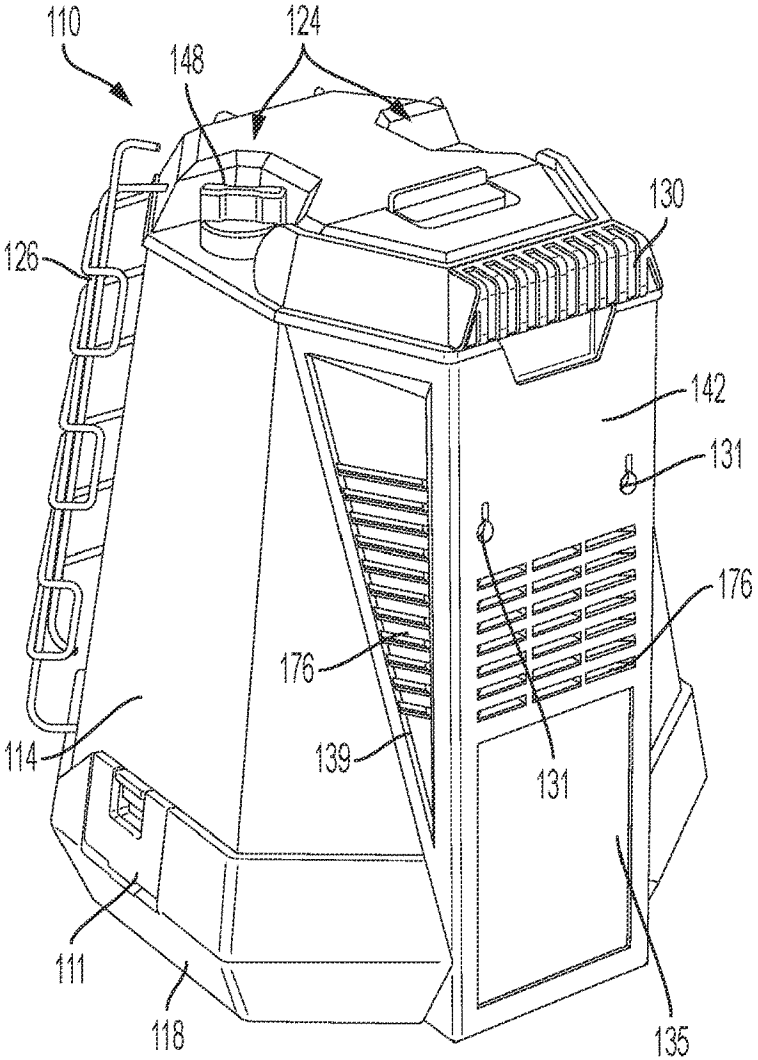
FIG. 10 is a rear perspective view of the portable heater of FIG. 9.

Now with reference to FIGS. 10 and 11, a rear portion of the housing 114 includes a door 142 that allows the operator to access an interior space of the heater 10. In the illustrated embodiment, the door 142 pivots about a pivot joint 144 (FIG. 11) positioned adjacent the base portion 118. The door 142 provides access to the interior space of the heater 110 so a user is able to access a connector 152 and a battery receptacle 134. In the illustrated embodiment, the connector 152 pivots about a pivot joint 153 so the user can install a fuel tank 146 (e.g., an 8 oz propane tank) having a combustible fuel in the heater 110. The battery receptacle 134 is positioned above the connector 152 proximate a top portion of the heater 110 and is sized to receive a battery pack 138 that powers the user interface 124 and an ignition assembly 160 (FIGS. 13 and 14) of the heater 10, as described in more detail below. The position of the battery receptacle 134 allows the battery pack 138 to be fully enclosed within the housing 114 when the door 142 is closed (FIG. 10) to protect the battery pack 138.

With continued reference to FIGS. 10 and 11, the heater 10 may include a compartment 111 positioned adjacent the base portion 118 (e.g., on a lower right side of the housing 114) that houses a second connector 113. The second connector 113 may be connected to an external fuel supply 115 (e.g., a 20 lb propane tank) via an adapter 117.

Figure 12:
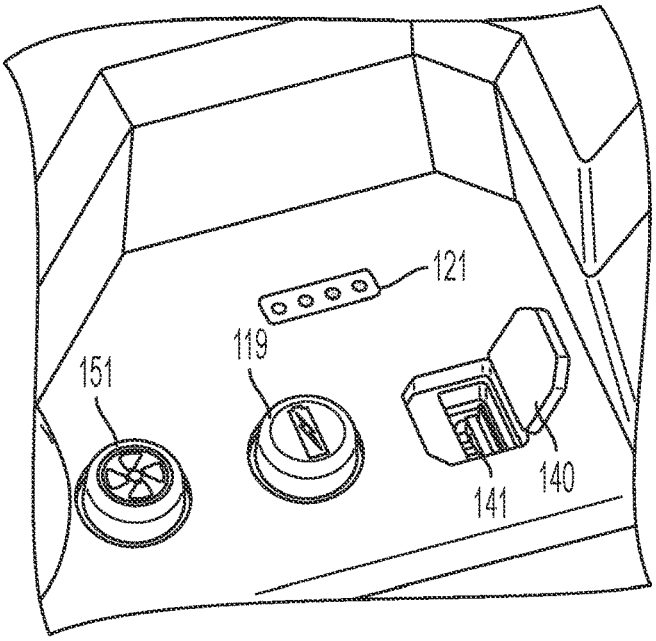
FIG. 12 is top view of a user interface of the portable heater of FIG. 9.

Now with reference to FIGS. 10 and 12, the user interface 124 includes a rotatable dial 148 (FIG. 10) for controlling a regulator valve in the heating assembly 122, thus controlling the temperature of the heating assembly 122. The user interface 124 also includes a USB door 140 (FIG. 12) that selectively encloses a USB port 141, a charging button 119 for selectively activating charging of an external device (e.g., a mobile device) connected to the USB port 141, a fan button 151 that selectively activates a fan 184 (FIG. 14), and an LED gauge 121 to display the amount of electrical power remaining in the battery pack 138. In the illustrated embodiment, the user interface 124 is recessed on the top portion of the heater 110 and the rotatable dial 148 is positioned on an opposing side of the heater 110 from the remaining components of the user interface 124.

Figure 13:
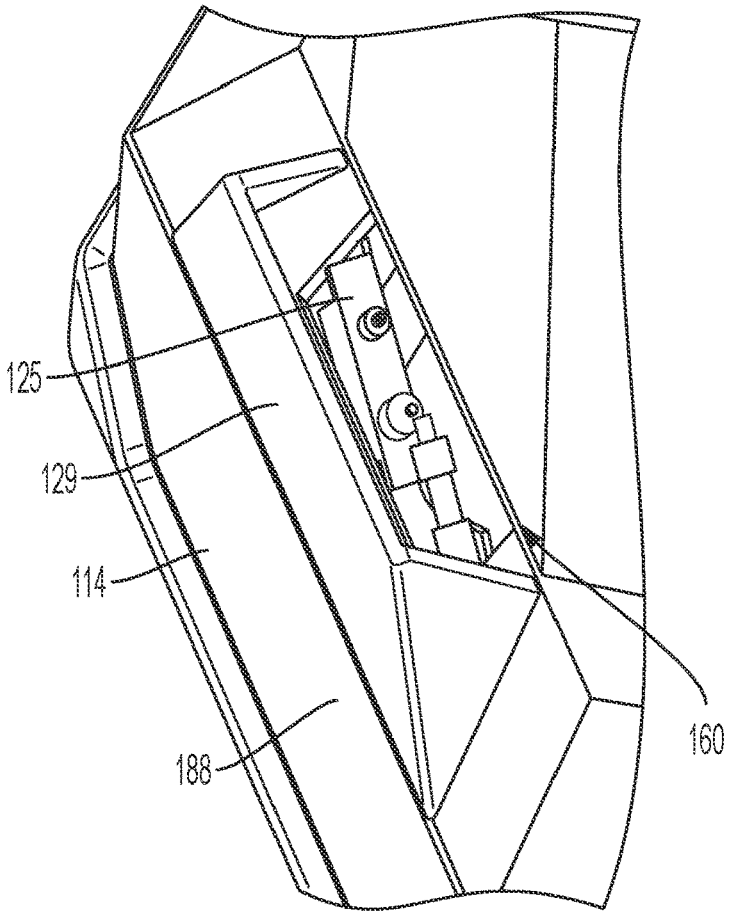
FIG. 13 is a front perspective view of the portable heater of FIG. 9, illustrating a pilot light.
Figure 14:
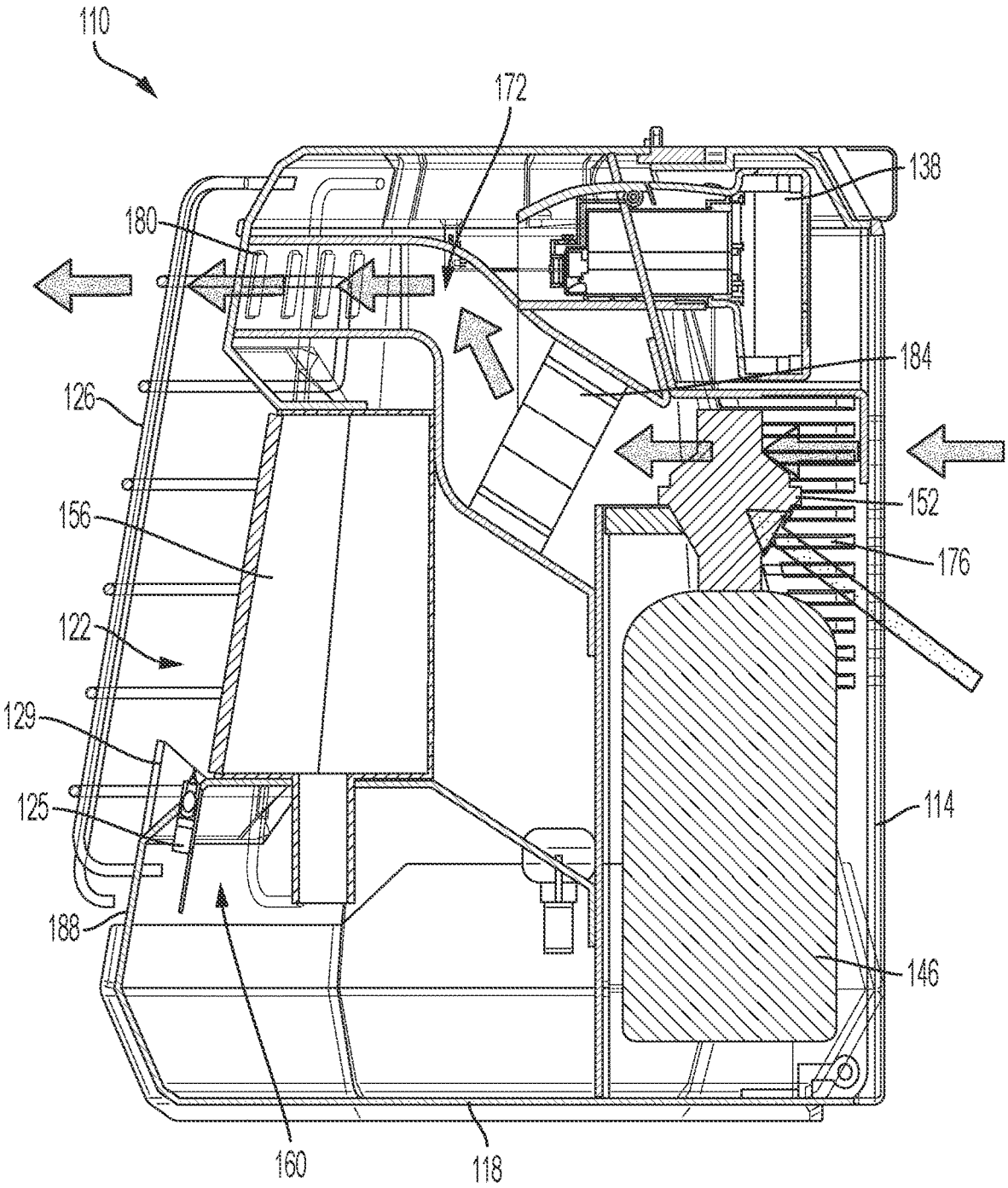
FIG. 14 is a side view of the portable heater of FIG. 9, illustrating an air flow path formed in the heater to disperse heated air to the surrounding environment.

Now with reference to FIGS. 13 and 14, the ignition assembly 160 includes a pilot light 125 that is positioned adjacent a radiant heating surface 156 (FIG. 14) of the heating assembly 122. The pilot light 125 is positioned behind a shield 129 that extends from a front face 188 of the heater 110. In the illustrated embodiment, the shield 129 is centered on the radiant heating surface 156 and prevents wind from affecting the pilot light 125.

With reference to FIG. 14, an air flow channel 172 is formed in the housing 114 and extends between a rear portion and a front portion of the housing 114. The air flow channel 172 defines an intake opening 176 in the rear portion of the housing 114 and an exhaust opening 180 in the front portion of the housing 114 proximate the radiant heating surface 156. A fan 184 is positioned within the air flow channel 172 proximate the intake opening 176. In the illustrated embodiment, the connector 152 and the fuel tank 146 are positioned between the fan 184 and the intake opening 176. Activation of the fan 184 (e.g., via the fan button 151 shown in FIG. 12) induces an airflow over the fuel tank 146 and the connector 152, through the air flow channel 172, and out of the exhaust opening 180. The airflow moving over the fuel tank 146 reduces heat surrounding the fuel tank 146 and the airflow that exits the exhaust opening 180 disperses the infrared radiant energy from the radiant heating surface 156 to the surrounding environment.

Now with reference to FIGS. 10, 11, and 14, the door 142 may include wall hanging attachments 131 (FIG. 10) formed as apertures that are sized to receive a screw. In the illustrated embodiment, the intake opening 176 includes a first plurality of openings 176 formed on a rear face 135 of the heater 110, a second plurality of openings 176 formed on a first angled rear surface 139 (FIG. 10), and a third plurality of openings 176 formed on a second angled rear surface 143 (FIG. 11). Therefore, the configuration of the intake opening 180 promotes the intake of air into the air flow channel 172. For example, when the heater 110 is attached to a wall via the wall hanging attachments 131, the first plurality of openings 176 on the rear face 135 of the heater 110 may be covered, but air may still enter the heater 110 through the second and third plurality of openings 176 on the first and second angled rear surfaces 139, 143.

Although the invention has been described in detail with reference to certain preferred embodiments, variations and modifications exist within the scope and spirit of one or more independent aspects of the invention as described.

Various features of the invention are set forth in the following claims.

What is claimed is:

1. A portable heater comprising:

a housing defining a base portion;

a radiant heating assembly positioned within the housing, the radiant heating assembly including a connector configured to receive a fuel tank having a combustible fuel, an ignition assembly configured to ignite the combustible fuel, and a radiant heating surface configured to be heated by ignition of the combustible fuel, the radiant heating surface configured to emit heat to a surrounding environment;

an air flow channel formed in the housing, the air flow channel defining an intake opening and an exhaust opening, the exhaust opening positioned proximate the radiant heating surface; and a fan positioned within the air flow channel to induce an airflow through the air flow channel, wherein the airflow exits the exhaust opening to disperse heat from the radiant heating surface to the surrounding environment, and wherein the ignition assembly is located outside the air flow channel.

2. The portable heater of claim 1, wherein the connector and the fuel tank are positioned between the fan and the intake opening, and wherein the fan is configured to induce airflow over the connector and the fuel tank to reduce heat surrounding the fuel tank.

3. The portable heater of claim 1, further comprising a battery receptacle configured to receive a battery to power the ignition assembly.

4. The portable heater of claim 3, further comprising a USB port configured to charge an external device via power from the battery.

5. The portable heater of claim 1, further comprising a user interface.

6. The portable heater of claim 5, wherein the user interface includes a rotatable dial configured to control an amount of combustible fuel provided to the radiant heating assembly, and wherein the rotatable dial is movable between an OFF state, an ignition state, and an ON state.

7. The portable heater of claim 5, wherein the user interface includes a display configured to display information about one or more of a state of the portable heater, an error message, or an external temperature of the surrounding environment.

8. The portable heater of claim 5, wherein the user interface includes a fan button configured to selectively activate the fan.

9. The portable heater of claim 1, wherein the radiant heating assembly further includes a second connector configured to connect an external fuel supply to the radiant heating assembly.

10. The portable heater of claim 1, further comprising a pivotable door configured to allow a user to access the connector for installation and replacement of the fuel tank.

11. The portable heater of claim 1, further comprising an oxygen sensor configured to detect whether a flame emitted by the ignition assembly has been extinguished, and a valve configured to selectively restrict fuel to the ignition assembly in response to the oxygen sensor detecting that the flame emitted by the ignition assembly has been extinguished.

12. The portable heater of claim 11, further comprising a tip-over switch in communication with the valve, wherein the tip-over switch is configured to send a signal to the valve to restrict fuel to the ignition assembly when the heater is tipped over.

13. A portable heater comprising:

a housing defining a base portion;

a heating assembly positioned within the housing, the heating assembly including a radiant heating surface configured to emit radiant energy to a surrounding environment;

an air flow channel formed in the housing, the air flow channel defining an intake opening and an exhaust opening, the exhaust opening positioned proximate the radiant heating surface; and a fan positioned within the air flow channel to induce an airflow through the air flow channel, wherein the airflow exits the exhaust opening to disperse heat from the radiant heating surface to the surrounding environment, and wherein the exhaust opening of the air flow channel is positioned above the radiant heating surface of the heating assembly.

14. The portable heater of claim 13, wherein the intake opening is defined by a plurality of openings.

15. The portable heater of claim 14, wherein the plurality of openings includes a first plurality of openings formed on a rear face of the heater, a second plurality of openings formed on a first angled surface of the heater, and a third plurality of openings formed on a second angled surface of the heater.

16. The portable heater of claim 13, wherein the exhaust opening is defined by a plurality of openings that are angled relative to each other to disperse the air moving through the air flow channel in multiple directions at the front of the housing.

17. The portable heater of claim 16, wherein the plurality of openings includes a first plurality of openings formed on a front face of the heater, a second plurality of openings formed on a first angled surface of the heater, and a third plurality of openings formed on a second angled surface of the heater.

18. A portable heater comprising:

a housing;

a radiant heating assembly positioned within the housing, the radiant heating assembly including a connector configured to receive a fuel tank having a combustible fuel, an ignition assembly configured to ignite the combustible fuel, and a radiant heating surface configured to be heated by ignition of the combustible fuel, the radiant heating surface configured to emit radiant energy to a surrounding environment;

an air flow channel formed in the housing, the air flow channel defining an intake opening and an exhaust opening;

a fan disposed within the air flow channel and operable to induce an airflow through the air flow channel, wherein the connector and the fuel tank are positioned between the fan and the intake opening, and wherein the airflow induced by the fan enters the air flow channel from an external environment, moves over the fuel tank to reduce heat surrounding the fuel tank, and exits the air flow channel to disperse heat from the radiant heating surface to the external environment.

19. The portable heater of claim 18, wherein the exhaust opening of the air flow channel is positioned above the radiant heating surface of the radiant heating assembly.

* * * * *